US007993193B2

(12) United States Patent
Falciglia, Sr.

(10) Patent No.: US 7,993,193 B2
(45) Date of Patent: Aug. 9, 2011

(54) DEVICE AND METHOD FOR PLAYING A BINGO-LIKE GAME

(76) Inventor: Sal Falciglia, Sr., Ridgewood, NJ (US)

( * ) Notice: Subject to any disclaimer, the term of this patent is extended or adjusted under 35 U.S.C. 154(b) by 888 days.

(21) Appl. No.: 11/580,728

(22) Filed: Oct. 13, 2006

(65) Prior Publication Data

US 2007/0232379 A1 Oct. 4, 2007

Related U.S. Application Data

(60) Provisional application No. 60/786,857, filed on Mar. 29, 2006.

(51) Int. Cl.
*A63F 9/24* (2006.01)

(52) U.S. Cl. ..... 463/19

(58) Field of Classification Search ..... 463/16–20, 463/22

See application file for complete search history.

(56) References Cited

U.S. PATENT DOCUMENTS

| | | | | |
|---|---|---|---|---|
| 4,743,024 | A | 5/1988 | Helm et al. | |
| 4,953,869 | A | 9/1990 | Muhammad | |
| 5,351,970 | A | 10/1994 | Fioretti | |
| 5,393,057 | A | 2/1995 | Marnell, II | |
| 5,411,258 | A | 5/1995 | Wilson et al. | |
| 5,647,798 | A | 7/1997 | Falciglia | |
| 5,695,400 | A | 12/1997 | Fennell, Jr. et al. | |
| 5,882,260 | A | 3/1999 | Marks et al. | |
| 5,935,002 | A * | 8/1999 | Falciglia | 463/19 |
| 5,971,849 | A | 10/1999 | Falciglia | |
| 6,190,255 | B1 | 2/2001 | Thomas et al. | |
| 6,280,328 | B1 | 8/2001 | Holch et al. | |
| 6,565,044 | B1 * | 5/2003 | Johnson et al. | 244/171.5 |
| 6,656,044 | B1 * | 12/2003 | Lewis | 463/19 |
| 6,994,625 | B2 | 2/2006 | Falciglia, Sr. | |
| 6,997,806 | B2 | 2/2006 | Falciglia, Sr. | |
| 2003/0017867 | A1 * | 1/2003 | deKeller | 463/18 |
| 2004/0009806 | A1 * | 1/2004 | Odom | 463/19 |
| 2004/0121834 | A1 * | 6/2004 | Libby et al. | 463/19 |

FOREIGN PATENT DOCUMENTS

| | | | |
|---|---|---|---|
| EP | 0 464 935 | A1 | 1/1992 |
| GB | 2 137 392 | A | 10/1984 |

* cited by examiner

*Primary Examiner* — David L Lewis
*Assistant Examiner* — Eric M Thomas
(74) *Attorney, Agent, or Firm* — Weide & Miller, Ltd.

(57) ABSTRACT

In a matching-type game, at least two matrices of symbols are displayed, the matrices positioned so that they have at least one row, column or diagonal aligned with one another. A player attempts to obtain matches of the displayed symbols in the matrices, such as to randomly generated game symbols. At least one winning outcome comprises a player's successful matching of all of the symbols along any contiguous row, column or diagonal spanning at least two of the aligned matrices. The game may be played as a wagering game at a gaming device.

26 Claims, 16 Drawing Sheets

PAYOUTS

CARD 1

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =3 | BET/CARD =6 | BET/CARD =9 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |

CARD 2

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |
| LONG HORIZONTAL COVERS (10) – 3 | LONG HORIZONTAL COVERS (10) – 6 | LONG HORIZONTAL COVERS (10) – 12 | LONG HORIZONTAL COVERS (10) – 24 |

FIG. 10A

CARD 3

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |
| LONG HORIZONTAL COVERS (10) – 3 | LONG HORIZONTAL COVERS (10) – 6 | LONG HORIZONTAL COVERS (10) – 12 | LONG HORIZONTAL COVERS (10) – 24 |
| LONG DIAGONAL COVERS (10) – 3 | LONG DIAGONAL COVERS (10) – 6 | LONG DIAGONAL COVERS (10) – 12 | LONG DIAGONAL COVERS (10) – 24 |

CARD 4

BONUS PAYOUTS

| BET PER CARD =1 | BET PER CARD =2 | BET PER CARD =4 | BET PER CARD =8 |
|---|---|---|---|
| 5 GOLD COINS – 500 | 5 GOLD COINS – 1,000 | 5 GOLD COINS – 2,000 | 5 GOLD COINS – 4,000 |
| 4 GOLD COINS – 25 | 4 GOLD COINS – 50 | 4 GOLD COINS – 100 | 4 GOLD COINS – 200 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 10 | 5 JOKERS – 20 | 5 JOKERS – 40 | 5 JOKERS – 80 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 100 | FULL CARD – 200 | FULL CARD – 400 | FULL CARD – 800 |
| LONG HORIZONTAL COVERS (10) – 3 | LONG HORIZONTAL COVERS (10) – 6 | LONG HORIZONTAL COVERS (10) – 12 | LONG HORIZONTAL COVERS (10) – 24 |
| LONG DIAGONAL COVERS (10) – 3 | LONG DIAGONAL COVERS (10) – 6 | LONG DIAGONAL COVERS (10) – 12 | LONG DIAGONAL COVERS (10) – 24 |

FIG. 10B

CARD 1

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |

CARD 2

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 5 | LONG HORIZONTAL COVERS (10) – 10 | LONG HORIZONTAL COVERS (10) – 20 | LONG HORIZONTAL COVERS (10) – 40 |

FIG. 11A

CARD 3

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 5 | LONG HORIZONTAL COVERS (10) – 10 | LONG HORIZONTAL COVERS (10) – 20 | LONG HORIZONTAL COVERS (10) – 40 |
| LONG DIAGONAL COVERS (10) – 5 | LONG DIAGONAL COVERS (10) – 10 | LONG DIAGONAL COVERS (10) – 20 | LONG DIAGONAL COVERS (10) – 40 |

CARD 4

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 5 | LONG HORIZONTAL COVERS (10) – 10 | LONG HORIZONTAL COVERS (10) – 20 | LONG HORIZONTAL COVERS (10) – 40 |
| LONG DIAGONAL COVERS (10) – 5 | LONG DIAGONAL COVERS (10) – 10 | LONG DIAGONAL COVERS (10) – 20 | LONG DIAGONAL COVERS (10) – 40 |

FIG. 11B

CARD 1

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =3 | BET/CARD =6 | BET/CARD =9 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |

CARD 2

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 10 | LONG HORIZONTAL COVERS (10) – 20 | LONG HORIZONTAL COVERS (10) – 30 | LONG HORIZONTAL COVERS (10) – 40 |

FIG. 12A

CARD 3

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 10 | LONG HORIZONTAL COVERS (10) – 20 | LONG HORIZONTAL COVERS (10) – 30 | LONG HORIZONTAL COVERS (10) – 40 |
| LONG DIAGONAL COVERS (10) – 10 | LONG DIAGONAL COVERS (10) – 20 | LONG DIAGONAL COVERS (10) – 20 | LONG DIAGONAL COVERS (10) – 40 |

CARD 4

BONUS PAYOUTS

| BET PER CARD =1 | BET PER CARD =2 | BET PER CARD =4 | BET PER CARD =8 |
|---|---|---|---|
| 5 GOLD COINS – 1,000 | 5 GOLD COINS – 2,000 | 5 GOLD COINS – 4,000 | 5 GOLD COINS – 8,000 |
| 4 GOLD COINS – 60 | 4 GOLD COINS – 120 | 4 GOLD COINS – 240 | 4 GOLD COINS – 480 |
| 3 GOLD COINS – 5 | 3 GOLD COINS – 10 | 3 GOLD COINS – 20 | 3 GOLD COINS – 40 |
| 2 GOLD COINS – 1 | 2 GOLD COINS – 2 | 2 GOLD COINS – 4 | 2 GOLD COINS – 8 |
| 5 JOKERS – 40 | 5 JOKERS – 80 | 5 JOKERS – 160 | 5 JOKERS – 320 |

REGULAR PAYOUTS

| BET/CARD =1 | BET/CARD =2 | BET/CARD =4 | BET PER CARD =8 |
|---|---|---|---|
| HORIZONTAL SLINGO – 1 | HORIZONTAL SLINGO – 2 | HORIZONTAL SLINGO – 4 | HORIZONTAL SLINGO – 8 |
| VERTICAL SLINGO – 1 | VERTICAL SLINGO – 2 | VERTICAL SLINGO – 4 | VERTICAL SLINGO – 8 |
| DIAGONAL SLINGO – 1 | DIAGONAL SLINGO – 2 | DIAGONAL SLINGO – 4 | DIAGONAL SLINGO – 8 |
| FULL CARD – 400 | FULL CARD – 800 | FULL CARD – 1,600 | FULL CARD – 3,200 |
| LONG HORIZONTAL COVERS (10) – 10 | LONG HORIZONTAL COVERS (10) – 20 | LONG HORIZONTAL COVERS (10) – 30 | LONG HORIZONTAL COVERS (10) – 40 |
| LONG DIAGONAL COVERS (10) – 10 | LONG DIAGONAL COVERS (10) – 20 | LONG DIAGONAL COVERS (10) – 20 | LONG DIAGONAL COVERS (10) – 40 |

FIG. 12B

DEVICE AND METHOD FOR PLAYING A BINGO-LIKE GAME

PRIORITY AND RELATED PATENTS

This application claims priority from a United States Provisional Application filed on Mar. 29, 2006 and assigned U.S. Provisional Application Ser. No. 60/786,857, the entire contents of which are incorporated herein by reference. This non-provisional application is related to U.S. Pat. Nos. 5,935,002 and 5,647,798. The entire contents of both U.S. patents are incorporated herein by reference.

BACKGROUND

1. Technical Field

This disclosure relates to devices for playing games and, more specifically, to a device and method for playing a Bingo-like game.

2. Description of the Related Art

Bingo has long been a popular game and various devices for use in association with the game have been developed. Traditionally, Bingo was played using hand cards or paper Bingo sheets which were difficult to facilitate repeated use. The Bingo numbers were "cancelled" by applying a chip to the card, or using a special marker or "dauber". With the advent of electronic online interactive games and casino slot machine games, it has become more popular, efficient and entertaining to use an interactive Bingo type game over the traditional paper Bingo type game. Further, in the drive to attract greater numbers of players, casinos strive to include games that are familiar, simple to understand, engaging, and entertaining.

Traditional Bingo games, either played with paper cards or electronic card representations are limited in the manner in which the results of a game may be displayed. In order to maintain player interest in the game, it is desirable to have an option of displaying results to the players in a variety of different fashions. It is also desirable to further increase the speed at which Bingo-type games may be played and to have the ability to play a plurality of Bingo cards at the same time.

It is an object of the present disclosure to offer a broad spectrum of single, dual and multiplayer games for players of different ages and interests. Still further there is a need for a device and method which permits the player to play more than one card at a time and wager a desired amount between a pre-selected maximum and minimum amount for each game with an option to wager a desired amount per card played.

SUMMARY

It is recognized that Bingo may be implemented in a more enjoyable manner to provide both multi-user play and to allow users to have greater selection and strategic interaction with the game as well as to compete with other players.

The present disclosure provides in one described embodiment a device for playing a Bingo-like game by a player. The device includes an input device for receiving user inputs from the player; and a display for displaying a graphic user interface (GUI). The GUI includes at least two n column by n row random number display matrices; and a first set of n random number display regions; and at least one actuation icon. The device further includes a processor, responsive to the user inputs, for executing an application program to cause the display of the GUI. The processor includes a first random number generator for generating random numbers to be displayed in at least one of the at least two n column by n row random number display matrices; and a second random number generator for generating a first set of random numbers responsive to actuation of the at least one actuation icon. Each random number of the first set is displayed by a respective one of the first of the n random number display regions. Each random number of the first set of random numbers corresponds to two display matrices of the at least two n column by n row random number display matrices. The processor further includes comparing means for comparing each of the first set of random numbers with the numbers displayed by the display matrices, and, for each match, the processor automatically covers the corresponding matching numbers displayed by the display matrices; and determining means for determining whether at least one of the at least two display matrices displays a predetermined amount of numbers contiguously matched in a row, a predetermined amount of numbers contiguously matched in a column, a predetermined amount of numbers contiguously matched in a diagonal, or all of the numbers of the at least two display matrices have been matched, and, if so, generating a Bingo indication signal for indicating a Bingo condition.

The device further includes a second set of n random number display regions; and a third random number generator for generating a second set of random numbers, responsive to actuation of the at least one actuation icon. Each random number of the second set is displayed by a respective one of the second set of the n random number display region. Each random number of the second set of random numbers corresponds to two additional display matrices of the at least two n column by n row random number display matrices.

Additionally, the device includes comparing means for comparing each of the second set of random numbers with the numbers displayed by the display matrices, and, for each match, the processor automatically covers the corresponding matching number displayed by the display matrices; and determining means for determining whether at least one of the at least two additional display matrices displays a predetermined amount of numbers contiguously matched in a row, a predetermined amount of numbers contiguously numbers matched in a column, a predetermined amount of numbers contiguously numbers matched in a diagonal, or all of the numbers of the at least two additional display matrices have been matched, and, if so, generating a Bingo indication signal for indicating a Bingo condition.

A random number of the first set of n random number display regions can match a random number in any column of the respective at least two n column by n row random number display matrices. The first set of n random numbers includes random numbers within a predetermined range and without repetition within the first set.

A random number of the second set of n random number display regions can match a random number in any column of the respective at least two additional n column by n row random number display matrices. The second set of n random numbers includes random numbers within a predetermined range and without repetition within the second set.

The first, second and third random number generators generate at least one random number selected from the group consisting of: a first set of random numbers ranging from 1 to 15; a second set of random numbers ranging from 16 to 30; a third set of random numbers ranging from 31 to 45; a four set of random numbers ranging from 46 to 60; and a fifth set of random numbers ranging from 61 to 75.

The second and third random number generators can randomly select symbols selected from the group consisting of a symbol which awards the player a predetermined number of points; a symbol which causes a number displayed by a display matrix of the at least two display matrices to be covered; a symbol which awards the player a free spin; and a symbol which enables the player to play a bonus round.

The device further includes means for receiving a bet from the player prior to actuation of the at least one actuation icon, and means for awarding a progressive jackpot to the player upon display by the first and second set of n random number display regions of a predetermined symbol and based on the player having placed a bet greater than a predetermined number and having selected at least four display matrices of the at least two display matrices. The means for awarding the progressive jackpot can include awarding credits equal to the amount of the progressive jackpot to the player by storing the credits on a card having a magnetic stripe and inserted within the device as known in the art.

The device can also have a plurality of input devices for receiving user inputs from a plurality of players.

BRIEF DESCRIPTION OF THE DRAWINGS

The features of the disclosed device and method for playing a Bingo-like game will become more readily apparent and may be better understood by referring to the following detailed description of illustrative embodiments of the present disclosure, taken in conjunction with the accompanying drawings, where:

FIGS. 10A-12B illustrate various payout tables in accordance with the present disclosure.

DETAILED DESCRIPTION

Figure 1:
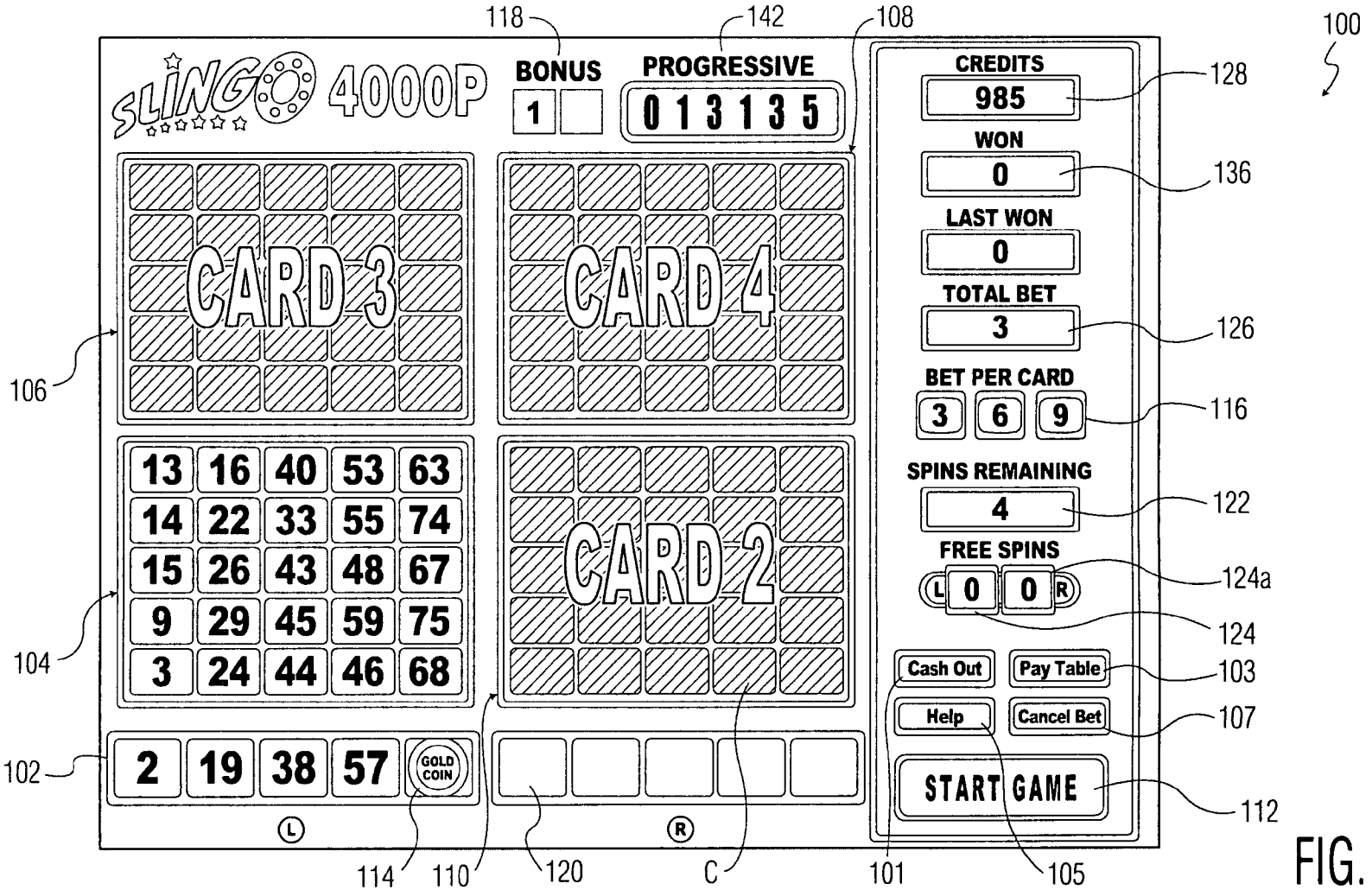
FIGS. 1-7 illustrate display screens of embodiments in accordance with the present disclosure.

Referring now in specific detail to the drawings, with like reference numerals identifying similar or identical elements, FIG. 1 is a front view of an embodiment of the present disclosure showing a display screen for playing the Bingo-like game according to the present disclosure. The game can be implemented as a computing device, such as a slot machine, and a stand-alone video game console, and as a computer-readable medium for downloading the game to a computing device, such as a slot machine, television set top box, video game console, cell phone, PDA, personal computer, etc. Hence, the display screens shown by the various figures are display screens as viewed by a player looking at a personal computer monitor, LCD display of a PDA, television screen, etc.

As shown by FIGS. 1-13, the display depicts a graphic user interface (GUI) 100 which includes display matrices 104, 106, 108 and 110 each having n rows and n column or n×n blocks or cells. In the embodiment described herein n is 5 and there are 25 blocks or cells "C" for each matrix as is customary in a traditional Bingo game card. As will become readily apparent to those skilled in the art, each cell C of the display matrices 104, 106, 108 and 110 can be a television or LCD screen, or each display matrix can be a single television or LCD screen, or the entire GUI can be displayed by a single display screen, such as a display screen of a television, personal computer, PDA, slot machine, cell phone, etc.

The user or player has the option of choosing to play any one or all of display matrices 104, 106, 108 and/or 110. For example, the player can choose to play one, two, three, or four 5×5 display matrices during a series of game plays. The user or player chooses which display matrices 104, 106, 108 and/or 110, he/she wants to play for the series of game plays by touching the GUI (touch screen GUI) or by other means, such as pushing buttons 2002, 2004, 2006, 2008 (see FIG. 14) corresponding to the display matrices 104, 106, 108 and 110.

In one embodiment, the device according to the present disclosure includes a processor, responsive to a user input via an actuation icon 112 labeled "START GAME", for executing an application program to cause a first random number generator of the processor to generate five sets of random numbers for each matrix chosen by the player. The five sets of random numbers are displayed by the five columns of each matrix chosen by the player. The five sets of random numbers are generated such that each set of random numbers is generated without repetition within the respective set and the other four sets.

The numbers range for each set of random numbers generated by the first random number generator is 1 to 75. Each set, however, is limited to a range within the range of 1 to 75. For example, of the five blocks or cells C corresponding to the leftmost column of the display matrices 104, 106, 108, and 110, the limited range is 1 to 15. The limited range for the second leftmost column of blocks or cells C of the display matrices 104, 106, 108, and 110 is 16 to 30. The limited range for the center column of blocks or cells C of the display matrices 104, 106, 108, and 110 is 31 through 45. The limited range for the second rightmost column of blocks or cells C of the display matrices 104, 106, 108, and 110 is 46 through 60. The limited range for the rightmost column of blocks or cells C of the display matrices 104, 106, 108, and 110 is 61 through 75. As in the game of Bingo, the first random number generator is designed such that a number is not displayed more than once by the display matrices 104, 106, 108 and 110 which are analogous to Bingo game cards.

The processor further includes a second random number generator, responsive to a user input, such as actuation or selection of the actuation icon 112, for generating at least one set of random numbers for display by the n display regions 102 and/or 120. As shown by the figures, the exemplary embodiment described herein has n equal to five.

The processor further includes a comparator, such as a comparator module having programmable instructions executable by the processor for comparing the at least one set of random numbers displayed by the n display regions 102 and/or 120 with the numbers displayed in the corresponding columns of the display matrices 104, 106, 108 and 110, and, if there is a match, allowing the processor to automatically cover the matching number in the display matrices 104, 106, 108 and 110 to indicate a match.

More particularly, each block or cell C of the display regions 102 and 120 corresponds to a respective column of two of the display matrices 104, 106, 108 and 110. The leftmost display region of display regions 102 corresponds to the leftmost column of the display matrices 104 and 106. The second leftmost display region of display regions 102 corresponds to the second leftmost column of the display matrices 104 and 106. The center display region of the display regions 102 corresponds to the center column of the display matrices 104 and 106. The second rightmost display region of the display regions 102 corresponds to the second rightmost column of the display matrices 104 and 106. The rightmost display region of the display regions 102 corresponds to the rightmost column of the display matrices 104 and 106.

Similarly, the leftmost display region of display regions 120 corresponds to the leftmost column of the display matrices 108 and 110. The second leftmost display region of display regions 120 corresponds to the second leftmost column of the display matrices 108 and 110. The center display region of the display regions 120 corresponds to the center column of the display matrices 108 and 110. The second rightmost display region of the display regions 120 corresponds to the second rightmost column of the display matrices 108 and 110. The rightmost display region of the display regions 120 corresponds to the rightmost column of the display matrices 108 and 110.

The processor further includes determining means, such as a determining module having programmable instructions executable by the processor for determining whether the display matrices 104, 106, 108 and 10 has a predetermined amount of numbers contiguously matched in a row of one matrix, a predetermined amount of numbers contiguously matched in a column of one matrix, and/or a predetermined amount of numbers contiguously matched in a diagonal of one matrix. The determining means also determines when the player has selected to play two or more matrices 104, 106, 108 and 110, whether there are a predetermined amount of numbers contiguously matched in a row spanning two matrices, a predetermined amount of numbers contiguously matched in a column spanning two matrices, and/or a predetermined amount of numbers contiguously matched in a diagonal spanning two matrices. The determining means also determines whether all of the numbers of the one or more matrices being played have been matched. If one or more of the above conditions are determined to have occurred by the determining means, the processor generates a Bingo indication signal for indicating a Bingo condition to the player. The Bingo indication signal can include an audiovisual indication signal, an audio indication signal or a visual indication signal for alerting the player of the Bingo condition, and/or the one or more rows and/or columns which caused the Bingo condition. In the embodiment shown by the figures, the predetermined number for obtaining a Bingo condition in one matrix is five, and the predetermined number for obtaining a Bingo condition by matching numbers spanning a row, a column and/or a diagonal of two matrices is ten.

The first and second random number generators are preferably comprised of a set of programmable instructions executable by the processor.

Figure 2:
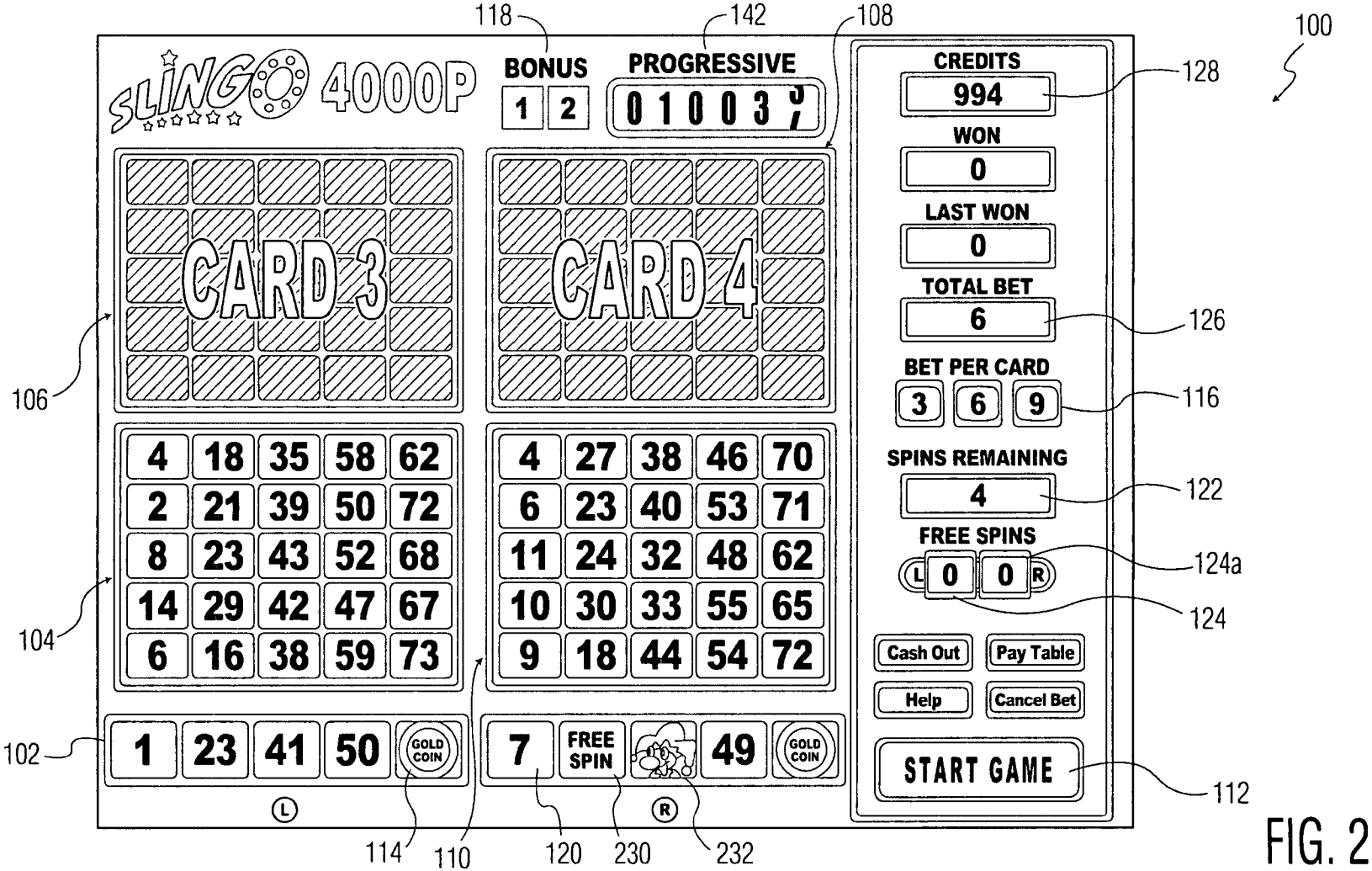
Figure 6:
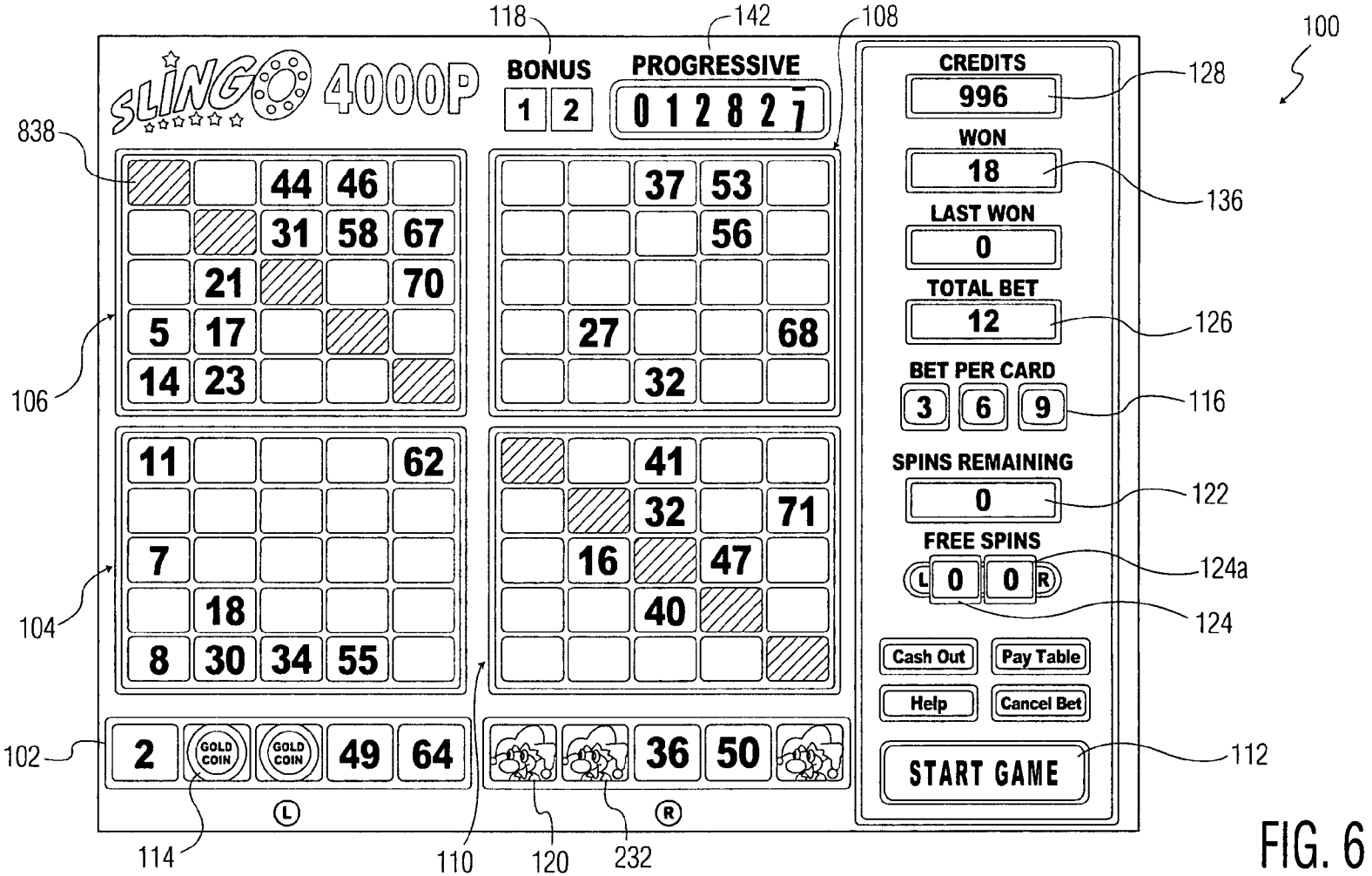

It has been found that a Bingo game played on the slot machine in this and similar embodiments can be enhanced when the random number display regions include special symbols in addition to the random numbers. Examples of special symbols which have been found to enhance the game include a "Free Spin" symbol 230 as shown in FIG. 2, which allows the player an extra spin if displayed, and a "Joker" symbol 232 which causes the processor to automatically select and cover any uncovered block within a column corresponding to the display region displaying the "Joker" symbol. Alternatively, the "Joker" symbol 232 causes the processor to automatically select and cover any uncovered block of the matrices corresponding to the n display regions which has the display region displaying the "Joker" symbol. Also shown by FIG. 2 is a "Gold Coin" symbol 114. The player is awarded additional credits if at least two "Gold coin" symbols 114 are displayed as shown by FIG. 6 and illustrated by the payout tables shown by FIGS. 10-13. Alternatively, the player can be awarded additional credits if at least one "Gold coin" symbol 114 is displayed as shown by FIG. 2.

Exemplary plays of a preferred embodiment would now be described in detail with reference to FIGS. 1-7 showing non-sequential display screens from different series of game plays. Each game play includes five plays. It is contemplated that a game play can include more than five plays due to free spins accumulated during the five plays.

As described above, the GUI 100 is configured with actuation icon 112 for starting the game after placing a bet and selecting which matrices to play. The GUI 100 further includes two sets of five random number display regions 102, 120. Each display region of the display regions 102 corresponds to a column of display matrices 104 and 106; each display region of the display regions 120 corresponds to a column of display matrices 108 and 110.

With reference to the figures, the GUI 100 also includes "Free Spin" displays 124 and **124*a* which indicate the cumulative total number of free spin symbols 230 displayed by random number display regions 102 and 120, respectively, during the series of game plays. The available free spins as displayed by display 124 can only be played using matrices 104 and 106, and the available free spins as displayed by display 124*a* can only be played using matrices 108 and 110**.

Figure 3:
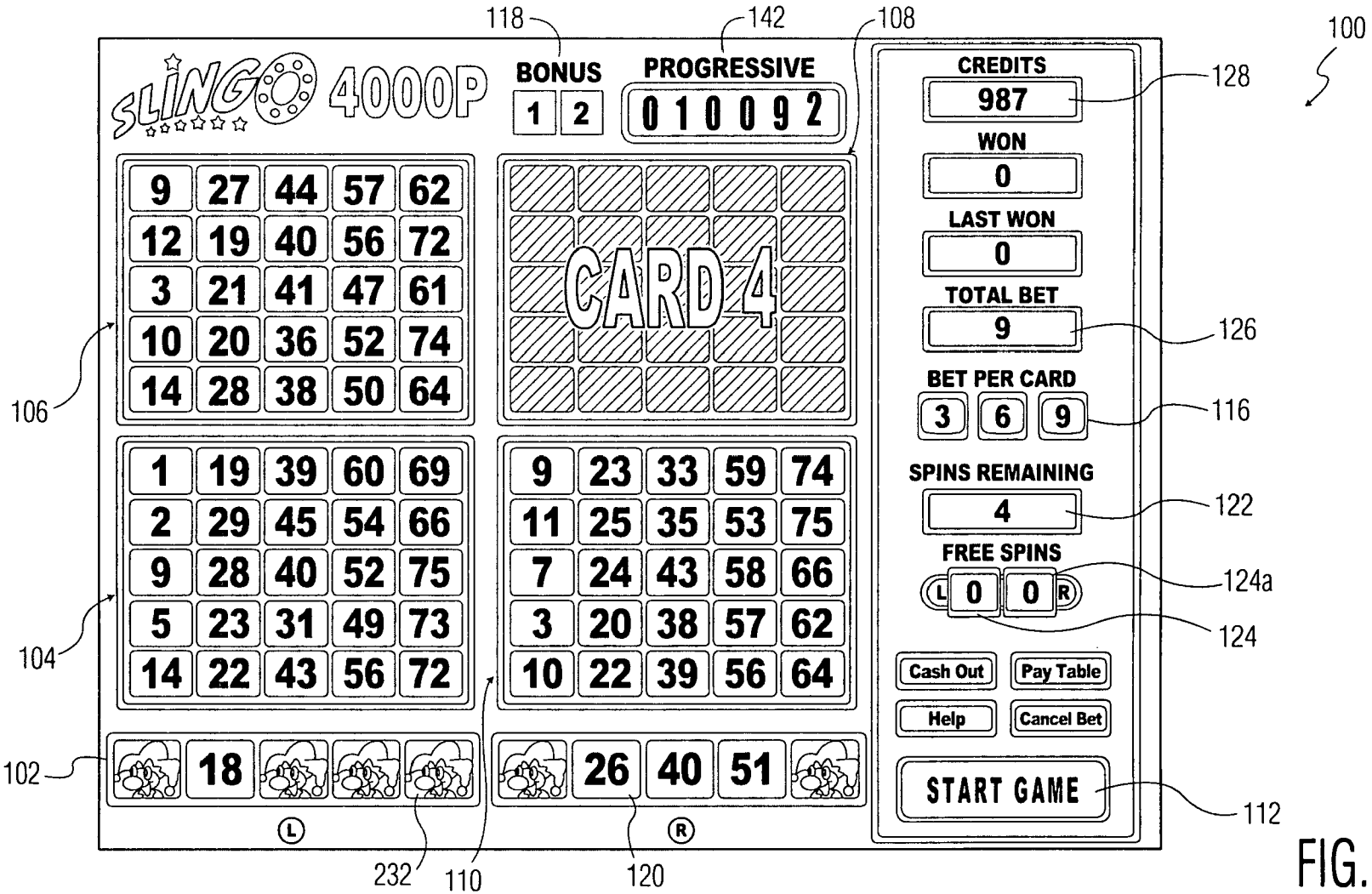

"Bet Per Card" display 116 indicates three different credits the user can bet, i.e., either 3, 6 or 9 credits, per matrix or "card" selected to be played. "Total Bet" display 126 indicates the cumulative bet for all matrices 104, 106, 108 and 110. FIG. 1 indicates that the player has bet 3 credits for display matrix 104 which was selected to be played; FIG. 2 indicates that the player has bet 3 credits for each display matrix 104 and 110 which was selected to be played for a total of 6 credits; FIG. 3 indicates that the player has bet 3 credits for each display matrix 104, 106 and 110 which was selected to be played for a total of 9 credits; and FIG. 4 indicates that the player has bet 3 credits for each display matrix 104, 106, 108 and 110 which was selected to be played for a total of 12 credits.

"Credits" display 128 indicates the amount of credits the player has and the "Won" display 136 indicates the amount of credits won by the player during the series of game plays or spins. "Spins Remaining" display 122 indicates the number of game plays or spins remaining. In the preferred embodiment, there is a minimum of five spins or game plays per game. That is, there are five game spins and the player can be awarded an infinite number of free spins.

"Bonus" display 118 indicates whether the user has obtained at least one bonus round play. One embodiment of a bonus round play is described below with reference to FIGS. 8 and 9. When display matrices 104 and/or 106 are played and bonus symbol 1340 (shown in FIG. 7) appears in one of the random number display regions of 102, "Bonus" display 118 indicates a 1. "Bonus" display 118 indicates a 2 in the right box (as shown in FIG. 2) if display matrices 108 and/or 110 are played and a bonus symbol appears in one of the random number display regions 120. If the player places a maximum "Total Bet" 126 of 9, selects all four matrices 104, 106, 108 and 110 to be played, and a bonus symbol appears in both random number display regions 102 and 120, the "Bonus" display indicates a 1 in the left box and a 2 in the right box and the "Progressive" jackpot as indicated by the "Progressive" display jackpot 142 is awarded to the player. The progressive jackpot is awarded to the player by methods known in the art, such as storing credits equal to the amount of the progressive jackpot on a card having a magnetic stripe and inserted within the device.

Other displays on the GUI 100 include a "Cash Out" display 101 which cashes out your winnings, a "Pay Table" display 103 which shows a pay table layout with respect to the amount bet per display matrix 104, 106, 108 and 110 (as shown in FIGS. 10-13), a "Help" display 105 for instructions and a "Cancel Bet" display 107 for cancelling the bet placed. The "Cancel Bet" display can also be provided as a button 2010 on a computing device 2000 as shown by FIG. 14.

FIG. 2 is a display screen of a particular, individual game play of the game according to the present disclosure. The player has selected to play display matrices 104 and 110. The user has a "Total Bet" 126 of three credits per display matrix and has four remaining spins or game plays as shown by display 122. During the game play, a "Gold coin" symbol 114 is randomly selected and displayed by one of the displays of display regions 102 and one of the displays of display regions 120. Since only one "Gold coin" symbol 114 is displayed by each display region 102 and 120, the player is not awarded any credits. As stated above, in the embodiment shown by the figures, there must be a minimum of two "Gold coin" symbols 114 displayed by a display region for the player to be awarded credits.

Further, during the game play as shown by FIG. 2, a "Free Spin" symbol 230 is displayed by one of the displays of display regions 120 and subsequently the "Free Spins" display 124*a* displays one free spin. During game play, a "Joker" symbol 232 is displayed by one of the displays of display regions 120. The "Joker" symbol 232 causes the processor to randomly select and cover a number displayed by a block of the center column of display matrix 110. The covered block will be displayed in a subsequent display screen following the display screen shown by FIG. 2. If covering a particular block will create a Bingo, the processor selects and covers that particular block.

FIG. 3 is a display screen of a particular, individual game play of the game according to the present disclosure. The player has selected to play display matrices 104, 106 and 110. The user has a "Total Bet" 126 of nine credits per display matrix and has four remaining spins or game plays as shown by display 122. During this individual game play, a "Joker" symbol 232 is randomly selected and displayed by four of the displays of display regions 102 and two of the displays of display regions 120. The player is hence awarded credits which are added to the previously awarded credits and the total number of credits is displayed by "Credits" display 128.

The "Joker" symbols 232 cause the processor to randomly select and cover a number displayed by a block of the leftmost, center, second rightmost and rightmost columns of display matrices 104 and 106. The "Joker" symbols 232 displayed by display regions 120 cause the processor to randomly select and cover a number in the leftmost and rightmost columns of matrix 110. The covered blocks will be displayed in a subsequent display screen following the display screen shown by FIG. 3.

Figure 4:
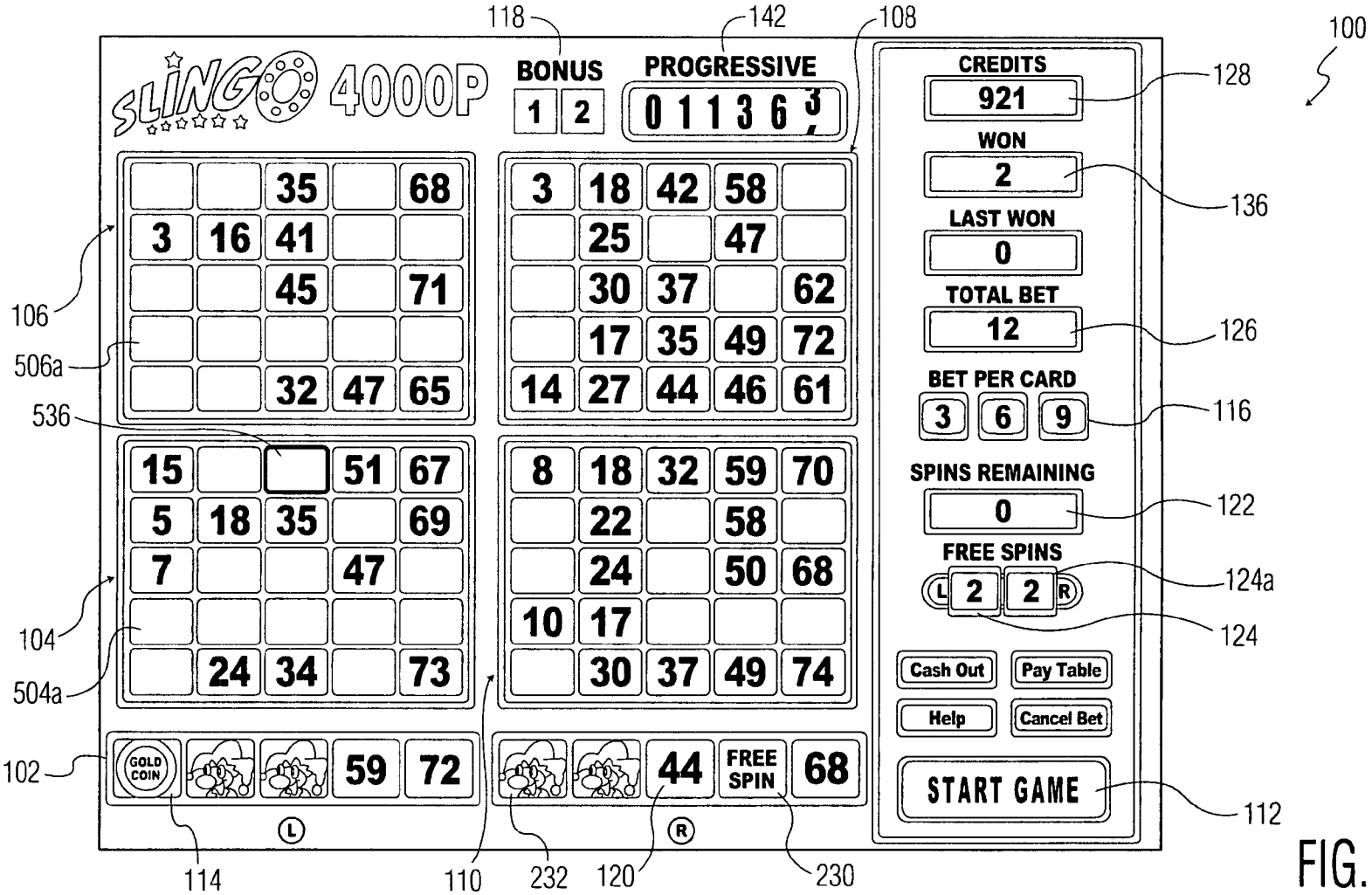

FIG. 4 is a display screen of a particular, individual game play of the game according to the present disclosure. The player has selected to play all the display matrices 104, 106, 108 and 110. The user has a "Total Bet" 126 of three credits per display matrix and has zero remaining spins or game plays as shown by display 122.

Further, during the game play as shown by FIG. 4, a "Free Spin" symbol 230 is displayed by one of the displays of display regions 120 and subsequently the "Free Spins" display 124*a* would displays three free spins. During game play, "Joker" symbols 232 are also displayed by two of the displays of display regions 102 and two of the displays of display regions 120. The "Joker" symbols 232 cause the processor to randomly select and cover a number displayed by a block of the second leftmost and center columns of display matrix 102 and 106, and to randomly select and cover a number displayed by a block of the leftmost and second leftmost columns of display matrices 108 and 110. The covered blocks will be displayed in a subsequent display screen following the display screen shown by FIG. 4. If covering particular blocks will create a Bingo, the processor selects and covers those particular blocks.

As shown by FIG. 4, the player has achieved two Bingo conditions; one in each of matrices 104 and 106. The two Bingo conditions are shown in display matrices 104 and 106 where five numbers were contiguously matched in rows 504*a* and 506*a*, respectively. A Bingo condition is achieved when five numbers in a row, five numbers in a column or five numbers in a diagonal are contiguously matched during one game play or over a series of game plays of the game in display matrices 104, 106, 108 and 110.

Figure 5:
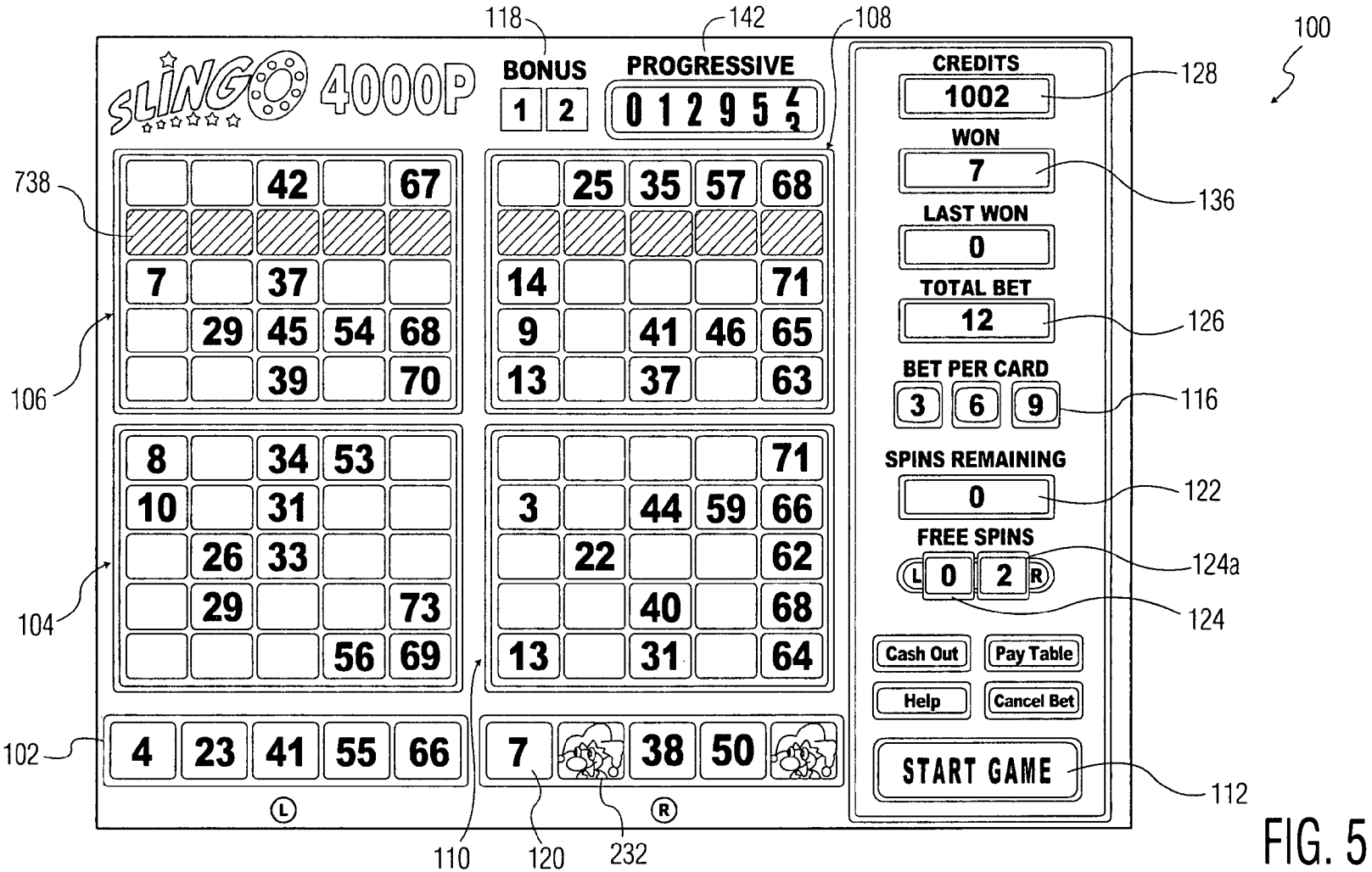

In FIG. 5, a "big slingo" or super Bingo condition is shown where ten numbers are contiguously matched in a row 738 spanning two matrices 106 and 108. A "big slingo" is achieved when ten numbers in a row, column or diagonal spanning two display matrices are contiguously matched. Additional credits are awarded to the player for achieving a "big slingo" and these credits are added to the previously awarded credits and the total number of credits is displayed by the "Credits" display 128. In alternate embodiments, a player can be awarded credits for contiguously matching numbers spanning two display matrices, where the amount of numbers matched is less than ten numbers, such as five numbers, where two numbers are matched in one matrix and three numbers are matched in the other matrix.

In FIG. 6, a "big slingo" is shown where ten numbers are contiguously matched in a diagonal 838 spanning two matrices 106 and 110.

Figure 7:
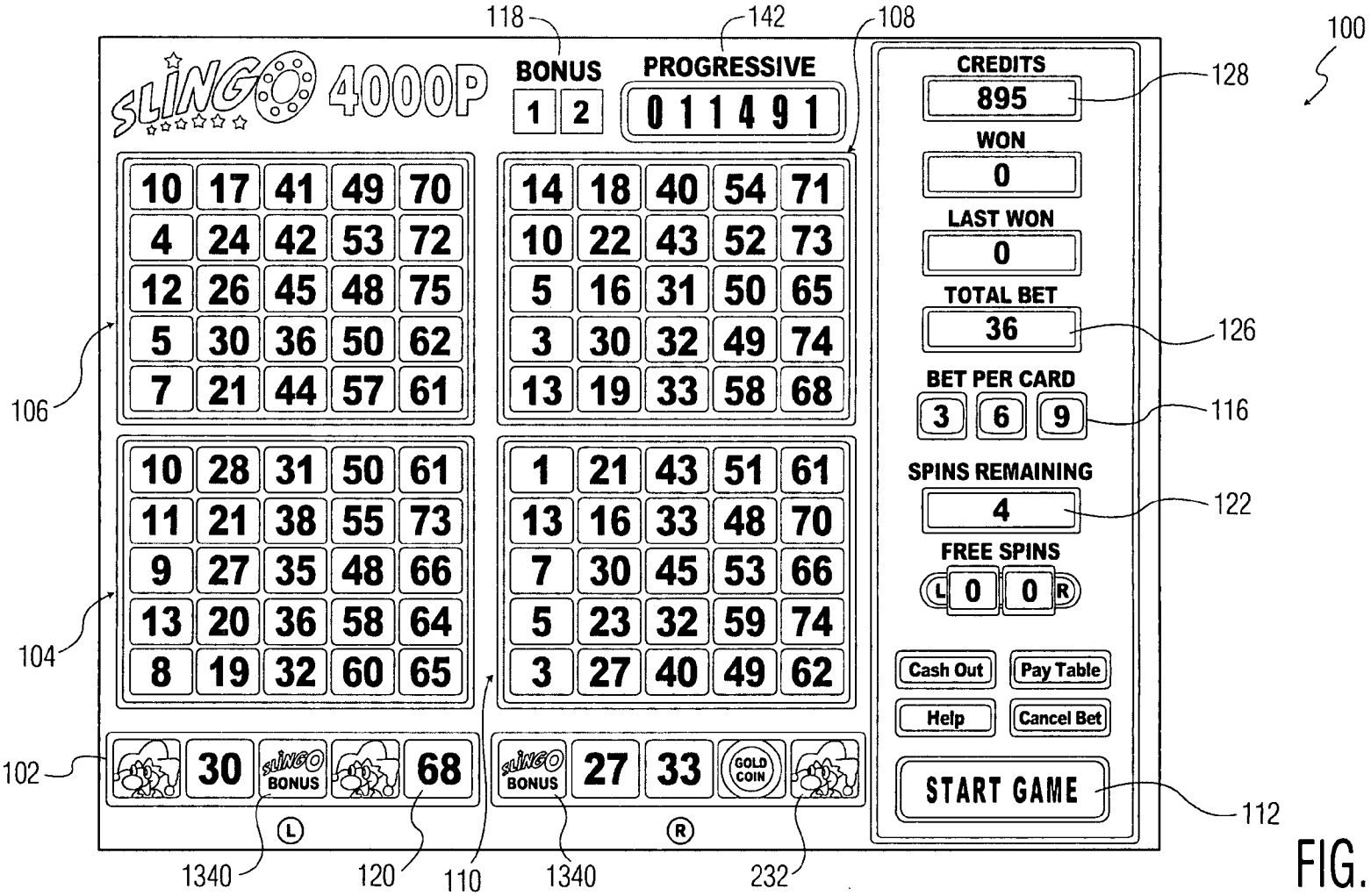
Figure 8:
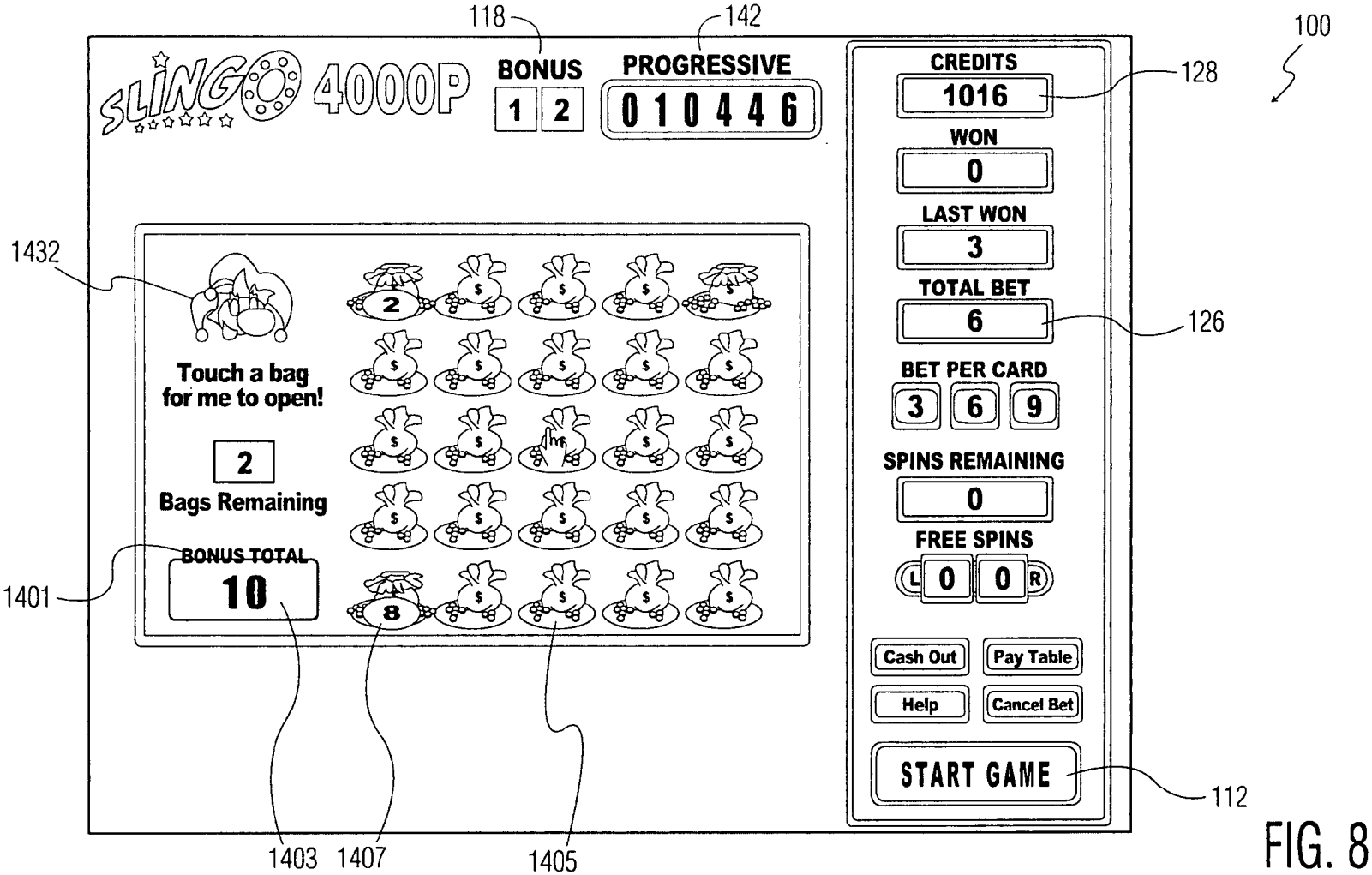
FIGS. 8-9 illustrate bonus round display screens in accordance with the present disclosure.
Figure 9:
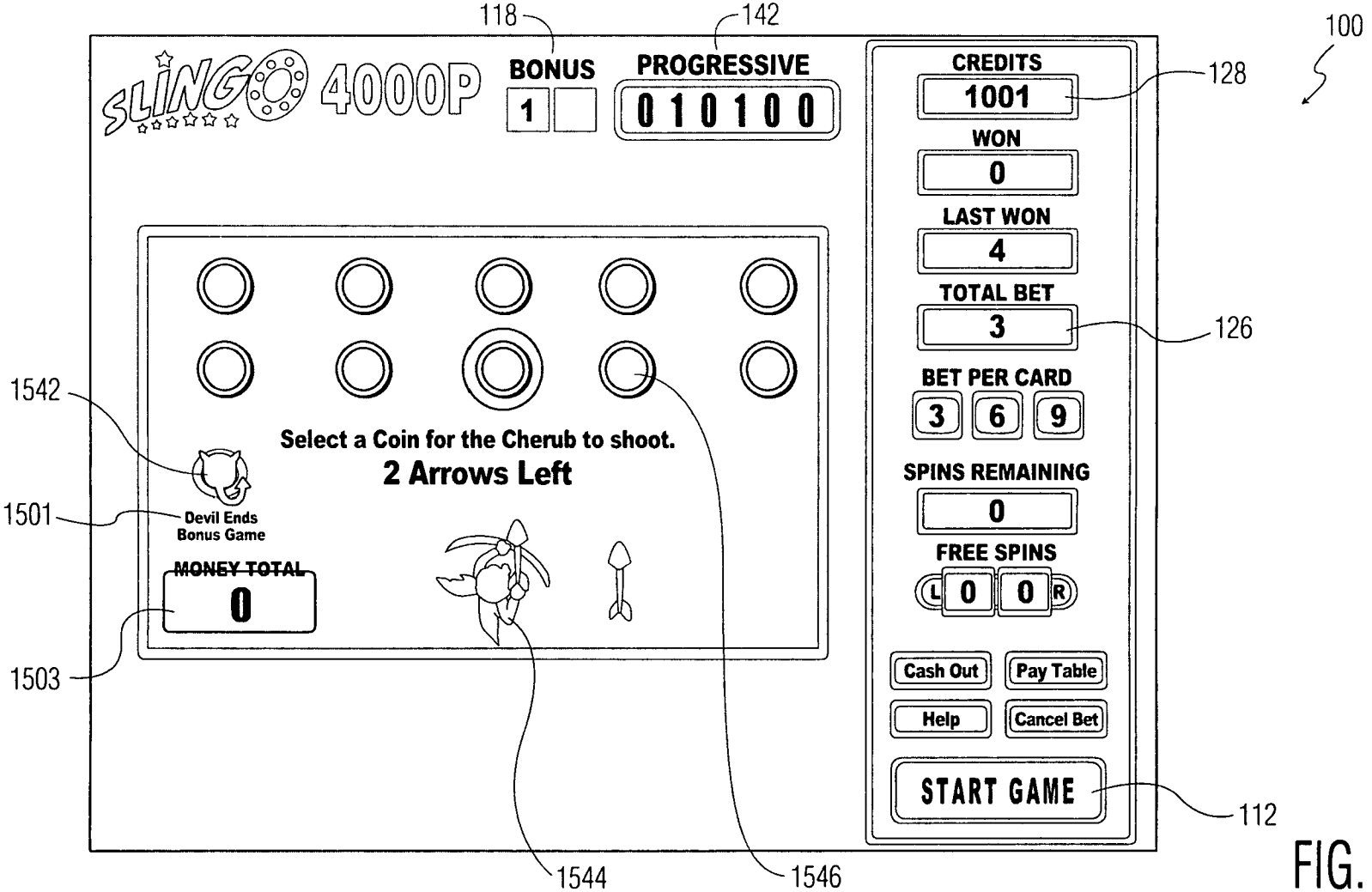

A description will now be provided regarding qualifying for a bonus round and playing a bonus round game with reference to FIGS. 7-9. It is contemplated that other bonus games can be implemented for the game according to the present disclosure besides the two bonus round games described herein.

In FIG. 7, a bonus symbol 1340 ("slingo bonus") and another bonus symbol 1340 are displayed in random number display regions 102 and 120. The occurrence of two bonus symbols being displayed in one of the display regions 102 and in one of the display regions 120 trigger the awarding of the progressive jackpot to the player if the other two conditions described above are also met. The occurrence of bonus symbols having been displayed by the display regions 102 and 120 during the series of game plays is indicated by "Bonus" display 118. The bonus round game is triggered if only one bonus symbol 1340 is displayed during the series of game plays by one of the display regions 102 and 120.

FIG. 8 shows a bonus round display screen 1401 of GUI 100. The user touches one of five bags of gold 1405 and "Joker" symbol 1432 opens each selected bag to reveal coins 1407 won or a "devil" symbol (not shown). If a devil is revealed, turn is lost. The user keeps selecting bags until all five bags of gold 1405 have been selected. A final bonus payout is accumulated and displayed by the "Bonus Total" display 1403 in which payouts are cumulative and multiplied by the bet per display matrix previously bet by the player during the series of game plays.

FIG. 9 shows another bonus round game having bonus round display screen 1501 of GUI 100. Cherub 1544 is randomly allocated one to five arrows. Ten coins 1546 are displayed and the cherub shoots an arrow at selected coins 1546 and reveals either bonus values of 4, 6, 10, 14, 20, 30, and 50, or a devil symbol 1542 which ends the bonus round play. A final bonus payout is accumulated and displayed by the "Bonus Total" display 1503 in which payouts are cumulative and multiplied by the bet per display matrix previously bet by the player during the series of game plays.

FIGS. 10A-12B are illustrative of payout tables for the Bingo-like game and the bonus round game for the game according to the present disclosure.

As described above, the object of the game is to be awarded credits by revealing "Gold coin" and "Joker" symbols, as well as achieving Bingo and "big slingo" conditions by matching and covering numbers on the display matrices with a minimum of 5 game spins and any free spins obtained.

There exist 64 possible winning Bingo and "big slingo" combinations or outcomes. These are covering a complete row of five blocks (five combinations) of a matrix, covering a complete column of five blocks (five combinations) of a matrix, covering a diagonal line of five blocks in either direction (two combinations) of a matrix, covering a complete row of ten blocks (ten combinations) spanning two matrices, covering a diagonal line of ten blocks in either direction (two combinations) spanning two matrices, and completely covering an individual matrix (four possibilities). It is envisioned that one or more of the above winning outcomes can be removed as a winning outcome. Credits are also awarded for winning the progressive jackpot. The credits can be redeemed for prizes, cash, or points, such as frequent flyer mileage points, etc. It is also envisioned that other winning combinations can be added to the above winning combinations, such as covering a complete column of ten blocks spanning two matrices.

In additional embodiments, a plurality of input devices are provided to the device for enabling multiple players to play the game simultaneously. The device receives user inputs from a plurality of players playing the Bingo-like game via the plurality of input devices.

Alternate variations on the game can be made. For example, one can vary the occurrence of the symbols which can be displayed by the display regions 102 and 120, as well as the minimum or maximum bet per card allowed and/or the amount of credits awarded for the various winning combinations.

As will become readily apparent to those skilled in the art, variations of the present method and device can be designed and built without departing from the scope of the claimed disclosure. For example, various embodiments can be fully incorporated into software and played on a computer or similar device.

Figure 13:
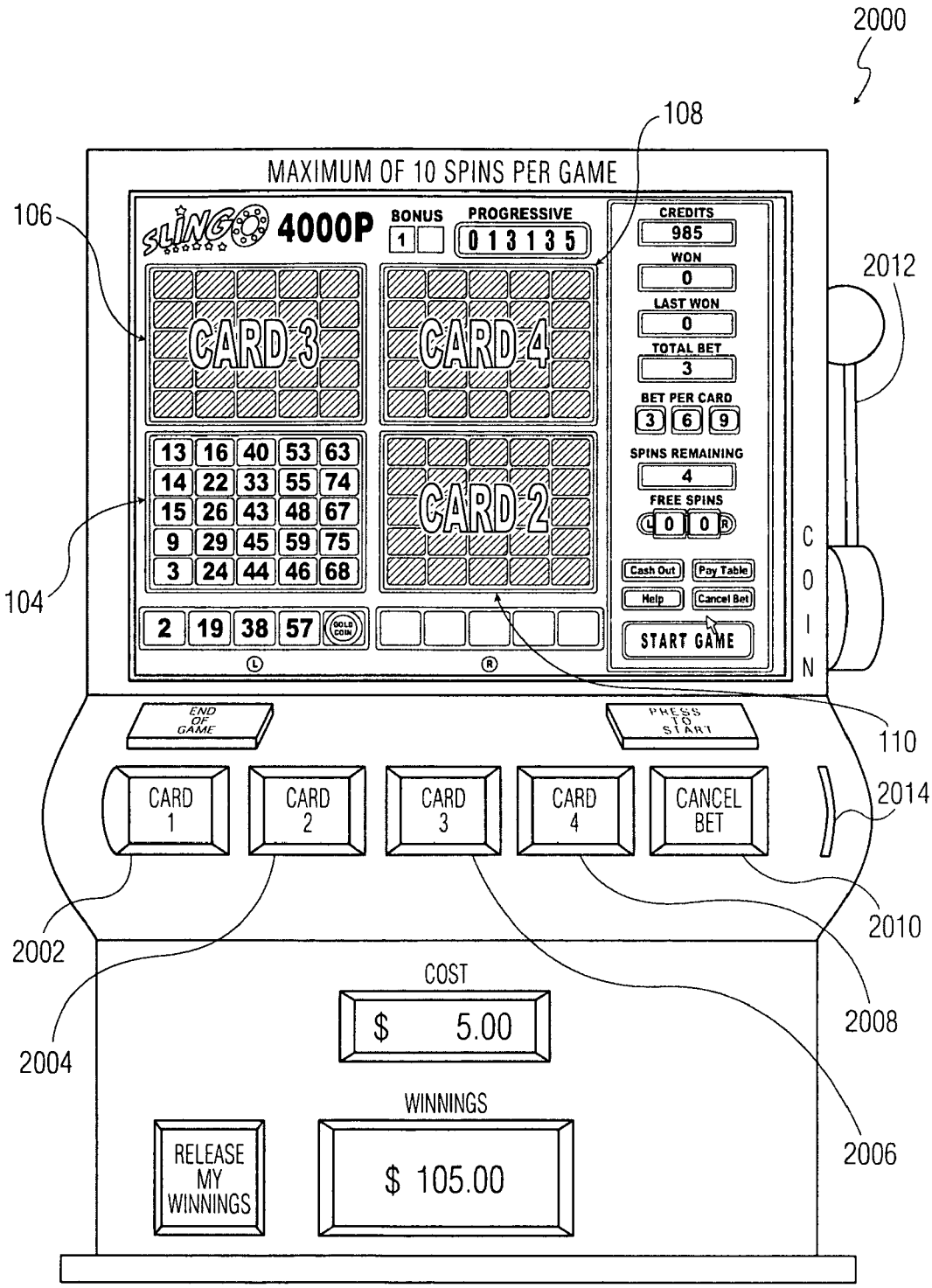
FIG. 13 is a front view of a computing device for playing the game in accordance with the present disclosure.

The disclosed device may also be configured as a slot machine 2000 having an activating arm 2012 and a coin slot 2014 for receiving bets from a player as typically found in a slot machine as shown in FIG. 13. The display regions 102 can also be configured as wheels which spin upon activation of the activating arm. Further, the input devices may be trackballs or other pointing and GUI devices, and the selectable display regions may include LED or LCD displays, which may be fixed in a housing or mounted on the spinning wheels of a slot machine.

The game can be implemented as a set of programmable instructions and game resources (graphics, audio, video, alphanumeric text, etc.) capable of being executed by a general purpose processor or a hard-wired special-purpose processor of a computer system, hand-held computing device, or other computing device, machine or apparatus for playing the game. The set of programmable instructions and game resources can be stored on a computer-readable medium, including optical, magnetic and opto-magnetic media.

Accordingly, while the disclosed device and method have been particularly shown and described with reference to the preferred embodiments, it is understood by those skilled in the art that various modifications in form and detail may be made therein without departing from the scope and spirit of the present disclosure.

I claim:

1. A device for playing a Bingo-like game by a player, said device comprising:

an input device for receiving user inputs from the player;

a display for displaying a graphic user interface (GUI) including:

at least two n column by m row random number display matrices, wherein n is at least 2, and wherein each display matrix has a number of display positions defining multiple rows, multiple columns and multiple diagonals, and wherein at least two of said display matrices are positioned so that they have at least one row, at least one column or at least one diagonal aligned with one another;

at least a first set of n random number display regions, wherein each set of random number display regions corresponds to at least one of said matrices, said n regions of each set corresponding to said n columns of said corresponding at least one matrice; and at least one actuation icon; and a processor, responsive to the user inputs, for executing an application program to cause the display of the GUI, the processor including:

at least a first random number generator for generating random numbers to be displayed in at least one of the at least two n column by m row random number display matrices and for generating a first set of random numbers responsive to actuation of the at least one actuation icon;

comparing means for comparing the random numbers in each of said n positions of said at least one set of random numbers with the numbers displayed in corresponding n columns of each row of said at least one corresponding display matrice; and determining means for determining whether all of the numbers along any contiguous rows, columns or diagonals of at least two of said matrices are matched and, if so, declaring a winning result.

2. The device according to claim 1 wherein a first and a second random number display matrix are positioned in vertical alignment so that said columns of said first and second matrices are aligned.

3. The device according to claim 2, wherein a random number in one of said n positions of a single first set of n random number display regions corresponds to both of said first and second random number display matrices.

4. The device according to claim 3, further comprising at least a third and a fourth random number display matrix, said third and fourth random display matrixes positioned in vertical alignment so that said columns of said third and fourth matrices are aligned, and further comprising a second set of n random number display regions, wherein said second set of random number display regions corresponds to both said third and fourth random number display matrices.

5. The device according to claim 1, wherein n=5 and the at least one first random number generator generates at least one random number selected from the group consisting of:

a first set of random numbers ranging from 1 to 15 for display in the n=1 positions of said matrices;

a second set of random numbers ranging from 16 to 30 for display in the n=2 positions of said matrices;

a third set of random numbers ranging from 31 to 45 for display in the n=3 positions of said matrices;

a fourth set of random numbers ranging from 46 to 60 for display in the n=4 positions of said matrices; and a fifth set of random numbers ranging from 61 to 75 for display in the n=5 positions of said matrices.

6. The device according to claim 1, wherein a first and a second random number display matrix are positioned in horizontal alignment so that said rows of said first and second matrices are aligned, wherein a single first set of n random number display regions corresponds to a first random number display matrix and further comprising a second set of n random number display regions corresponding to said second random number display matrix.

7. The device according to claim 1, further comprising means for receiving a bet from the player prior to actuation of the at least one actuation icon.

8. The device according to claim 1, further comprising means for awarding a progressive jackpot to the player upon display of a predetermined symbols in any of the positions of the at least one by the first random number display region.

9. The device according to claim 1, wherein the device is a handheld computing device or a slot machine or other computing device.

10. The device according to claim 1, further comprising a plurality of input devices for receiving user inputs from a plurality of players.

11. The device according to claim 1, wherein n is 5 and m is 5.

12. The device according to claim 1, further comprising declaring a winning outcome if all of the numbers of at least one of said random number display matrices are matched.

13. The device according to claim 1, comprising four random number display matrices, a first and a second of said matrices being horizontally aligned and a third and a fourth of said matrices being horizontally aligned, and said first and third matrices being vertically aligned and said second and fourth matrices being vertically aligned.

14. A method for playing a Bingo-like game by a player comprising the steps of:

displaying a graphic user interface (GUI) including:

at least two n column by m row random number display matrices, wherein n is at least 2, and wherein each display matrix has number of display positions defining multiple rows, multiple columns and multiple diagonals, and wherein at least two of said display matrices are positioned so that they have at least one row, at least one column or at least one diagonal aligned with one another;

at least a first set of n random number display regions wherein each set of random number display regions corresponds to at least one of said matrices, said n regions of each set corresponding to said n columns of said corresponding at least one matrice; and at least one actuation icon; and generating n random numbers to be displayed in at least one of the at least two n column by m row random number display matrices;

generating and displaying a first set of n random numbers responsive to actuation of the at least one actuation icon;

comparing the random numbers in each of said n positions of said set of random numbers with the numbers displayed in corresponding n columns of each row of said at least one corresponding display matrix; and determining whether all of the numbers along any contiguous rows, columns or diagonals of at least two of said matrices are matched and, if so, declaring a winning result.

15. The method according to claim 14, further comprising the steps of aligning a first and a second random number display matrix vertically so that said columns of said matrices are aligned.

16. The method according to claim 13, wherein a random number in one of said n positions of a single first set of n random number display regions corresponds to both of said first and second random number display matrices.

17. The method according to claim 16, further comprising at least a third and a fourth random number display matrix, said third and fourth random display matrices positioned in vertical alignment so that said columns of said third and fourth matrices are aligned, and further comprising generating a second set of n random numbers, wherein said second set of random number display regions corresponds to both said third and fourth random number display matrices.

18. The method according to claim 14, wherein n=5 and the at least one random number is selected from the group consisting of:

a first set of random numbers ranging from 1 to 15 for n=1;

a second set of random numbers ranging from 16 to 30 for n=2;

a third set of random numbers ranging from 31 to 45 for n=3;

a fourth set of random numbers ranging from 46 to 60 for n=4; and a fifth set of random numbers ranging from 61 to 75 for n=5.

19. The method according to claim 14, wherein a first and a second random number display matrix are positioned in horizontal alignment so that said rows of said first and second matrices are aligned, wherein a single first set of random number display regions corresponds to said first random number display matrix and further comprising a second set of random number display regions corresponding said second random number display matrix.

20. The method according to claim 15, wherein the displaying, generating, comparing and determining steps are implemented in software and operated on a computer system, a handheld computing device or slot machine.

21. The method according to claim 15, further comprising the step of receiving a bet from the player prior to actuation of the at least one actuation icon.

22. The method according to claim 21, further comprising awarding a progressive jackpot to the player upon display of a predetermined symbol in any of the positions of the at least one first random number display.

23. The method according to claim 14, further comprising a plurality of input devices for receiving user inputs from a plurality of players.

24. The method according to claim 14, wherein n is 5 and m is 5.

25. The method according to claim 14, further comprising declaring a winning outcome if all of the numbers of at least one of said random number display matrices are matched.

26. The method according to claim 14, comprising four random number display matrices, a first and a second of said matrices being horizontally aligned and a third and a fourth of said matrices being horizontally aligned, and said first and third matrices being vertically aligned and said second and fourth matrices being vertically aligned.

* * * * *